US006587022B1

(12) United States Patent
Devine

(10) Patent No.: US 6,587,022 B1
(45) Date of Patent: Jul. 1, 2003

(54) FOLDABLE PORTABLE MAGNETIC TOOL MAT

(76) Inventor: Rita M. Devine, 2930 Prospect St., Sarasota, FL (US) 34239

( * ) Notice: Subject to any disclaimer, the term of this patent is extended or adjusted under 35 U.S.C. 154(b) by 17 days.

(21) Appl. No.: 10/101,085

(22) Filed: Mar. 19, 2002

(51) Int. Cl.[7] ..... B65D 73/00; B65D 85/28; A45C 11/26; H01F 7/02; A45F 5/00

(52) U.S. Cl. ..... 335/285; 335/303; 224/183; 211/DIG. 1; 206/350; 248/309.4

(58) Field of Search ..... 335/285, 303; 224/183, 250, 901, 907; 211/DIG. 1; 206/373, 214, 350; 248/309.4

(56) References Cited

U.S. PATENT DOCUMENTS

| | | | |
|---|---|---|---|
| 2,597,601 | A | 5/1952 | Sherman |
| 3,665,355 | A | 5/1972 | Sasaki |
| 3,924,212 | A | 12/1975 | Brown |
| 4,826,059 | A | 5/1989 | Bosch |
| 5,760,668 | A | 6/1998 | Testa |
| 6,267,277 | B1 | 7/2001 | Taylor |
| 6,336,555 | B1 | 1/2002 | Breeden |

*Primary Examiner*—Ramon M. Barrera
(74) *Attorney, Agent, or Firm*—Charles J. Prescott

(57) ABSTRACT

A foldable, portable, magnetic tool mat. The tool mat includes generally rectangular obverse and reverse panels each formed of flexible material and connected together along substantially common side and end margins and along evenly spaced apart seam lines extending between said side margins defining elongated magnet bar holding portions. An elongated permanent magnet bar is held within each holding portion each without substantially inhibiting selective tool mat folding for fit and storage. The reverse panel is substantially thicker than the obverse panel for better wear characteristics and maximal magnetic attractive forces for tool and hardware retention. An attaching strap holds the tool mat.

8 Claims, 6 Drawing Sheets

FOLDABLE PORTABLE MAGNETIC TOOL MAT

BACKGROUND OF THE INVENTION

1. Scope of Invention

This invention relates generally to portable magnetic tool holders, and more particularly to a flexible, collapsible mat particularly sized for use atop a collapsible ladder or around the leg of a user.

2. Prior Art

More and more people are venturing into the home improvement area, both on a homeowner basis and professionally. Many of the tools, accessories and work items are made of magnetically attractable material. The more readily accessible these tools and other magnetically attractable items are to the user, the greater the likelihood of project success and shortened the time for project completion.

A number of prior art devices provide a magnetic attraction means for magnetically retaining work items in a stored or in a readily accessible position. One such device is disclosed in U.S. Pat. No. 6,267,277 invented by Taylor which discloses a portable, flexible tool holder having a plurality of pockets and loops therein for holding tools or, in lieu thereof, magnets associated with each pocket for the same purpose of holding tools in place within the pocket.

Another magnetic tool holder invented by Bosch is disclosed in U.S. Pat. No. 4,826,059 teaching a magnetic tool holder, preferably in the form of an apron, which includes a set of magnetic bars positioned side by side so as to provide magnetic attraction on both sides thereof. The length of the magnetic bars, being less than half the width of the device, is such that the tool holder may be easily folded along specific center fold lines for storage.

A protective fender cloth provides magnetic flexible strips as disclosed in U.S. Pat. No. 3,924,212 invented by Brown having the magnetic strips positioned on alternate sides of the device to render the cloth non-slipable when placed atop a magnetically attractable fender of a vehicle.

Other magnetic material-based devices are disclosed in U.S. Pat. No. 3,665,355 invented by Sasaki, Sherman's invention directed to a fisherman's hatband as disclosed in U.S. Pat. No. 2,597,601, a magnetic tool and object holder invented by Testa as disclosed in U.S. Pat. Nos. 5,760,668 and in 6,336,555, Breeden discloses a magnetic school organizer.

The present invention provides a portable and easily deployable and collapsible magnetic tool mat which is particularly sized to fit atop and be secured to a top ladder or platform of a collapsible ladder. An auxiliary strap is also provided to, in effect, lengthen the device so that it may be retained around the thigh of a user for retention of magnetically attractable articles.

BRIEF SUMMARY OF THE INVENTION

This invention is directed to a foldable, portable, magnetic tool mat. The tool mat includes generally rectangular obverse and reverse panels each formed of flexible material and connected together along substantially common side and end margins and along evenly spaced apart seam lines extending along substantially the length of the device between said side margins defining elongated magnet bar holding portions. An elongated permanent magnet bar is held within each magnetic holding portion without substantially inhibiting selective tool mat deployment and folding for storage. The reverse panel is substantially thicker than the obverse panel for better wear characteristics and maximal magnetic attractive forces for tool and hardware retention. An attaching strap holds the tool mat to a support surface.

It is therefore an object of this invention to provide a magnetic tool mat which is easily portable and deployable, both aspects being facilitated by the positioning and orientation of the elongated closely spaced magnetic bars held therein.

It is another object of this invention to provide a magnetic tool mat which is sized for close-fitting alignment with, and securement atop the top of a collapsible ladder It is still another object of this invention to provide a portable magnetic tool mat which may be secured around the thigh of the user to hold magnetically attractable tool and accessories and items in readily accessible reach by a wearer of the device.

In accordance with these and other objects which will become apparent hereinafter, the instant invention will now be described with reference to the accompanying drawings.

DETAILED DESCRIPTION OF THE INVENTION

Figure 1:
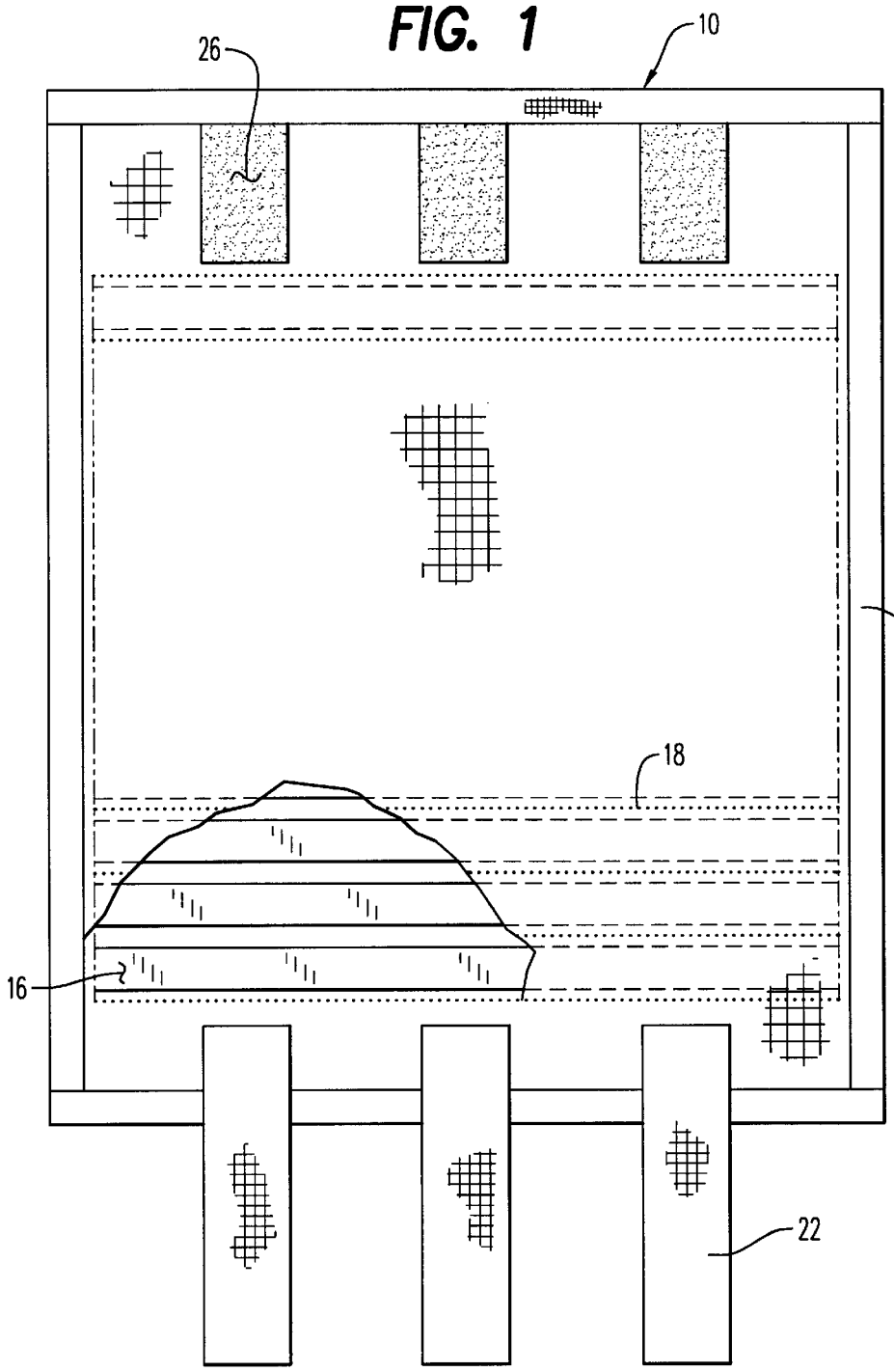
FIG. 1 is a broken plan view of the invention.
Figure 2:
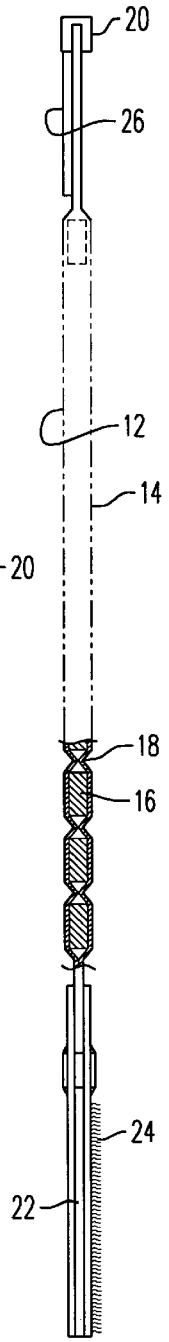
FIG. 2 is a right end elevation view of FIG. 1.
Figure 3:
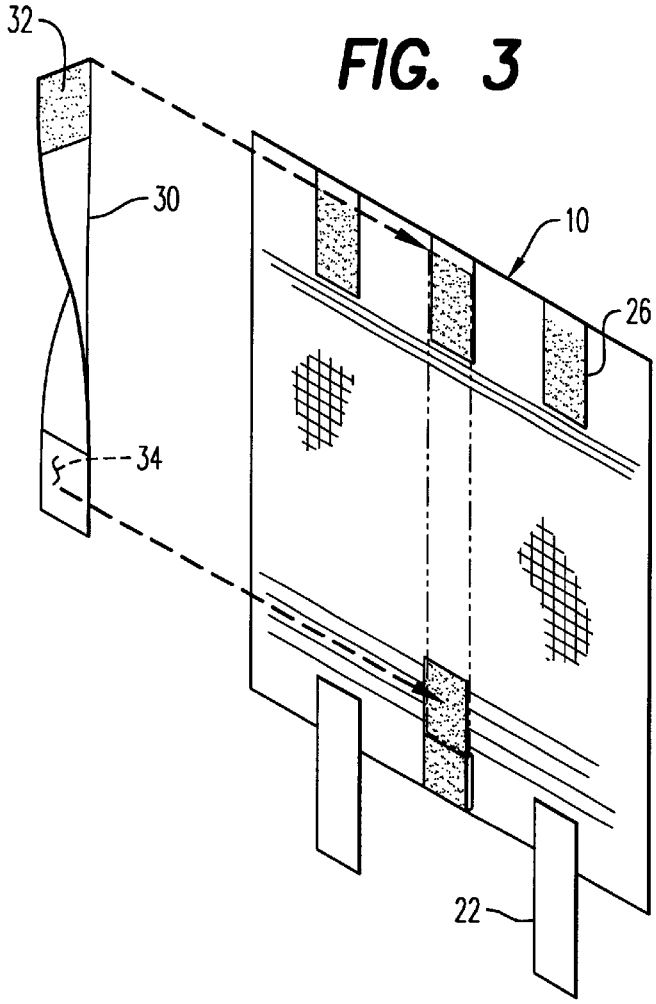
FIG. 3 is a simplified perspective view of the invention showing an optional auxiliary strap.
Figure 4:
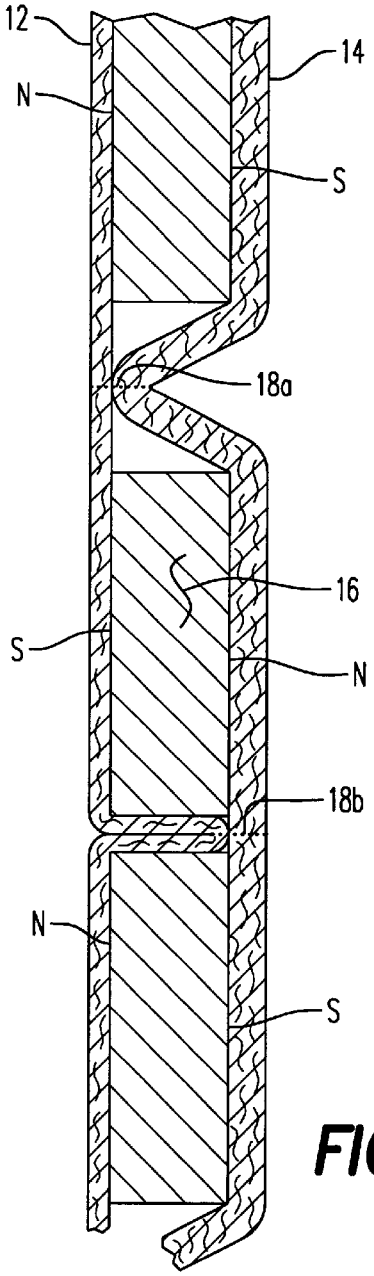
FIG. 4 is a longitudinal section view through a portion of FIG. 1.

Referring now to the drawings, the invention in the open configuration is best seen in FIGS. 1 to 3 generally at numeral 10. The tool mat 10 has a generally rectangular plan configuration and, as best seen in FIGS. 2 and 4, is constructed of an obverse panel 12 and a reverse panel 14 which are connected along common side and end margins and then finished in appearance by sewing binding material 20 along substantially all of the side and edge margins.

The obverse panel 12 is formed of relatively thinner flexible elastic fabric material, preferably about 210 denier nylon material. PVC sponge material of comparable thickness and elasticity is an alternative. The reverse panel 14 is formed of substantially heavier flexible material, preferably 2000 denier nylon or Ballistic Cordura. In addition to these panels 12 and 14 being connected together along their common side and end margins, they are also connected together along seam lines 18 in FIGS. 1 and 2 and 18*a* and 18*b* shown in FIG. 4. These seam lines 18, 18*a* and 18*b* are spaced apart in generally parallel fashion one to another and parallel to the end margins so as to define a plurality of closely spaced side by side elongated magnetic bar holding portions which are sized to snugly receive an elongated magnetic bar 16 positioned and secured therein as best seen in FIGS. 1, 2 and 4. These magnetic bars 16 are formed of highly magnetic material such as sintered ferrite C8 or anisotropic bonded ferrite for added toughness and are well known in the industry for high magnetic strength.

As previously described, the obverse panel 12 is formed of relatively thin fabric material so as to minimize the loss of magnetic attraction by minimizing the space between a tool placed against the obverse panel 12 and each magnet 16 itself. The reverse surface 14, being formed of heavier flexible fabric material, is positionable against a work surface or a substrate which may be irregular, soiled and otherwise contaminated and, therefore, a heightened wear resistivity is provided through the preferred use of the heavier, more durable obverse panel material.

Figure 5:
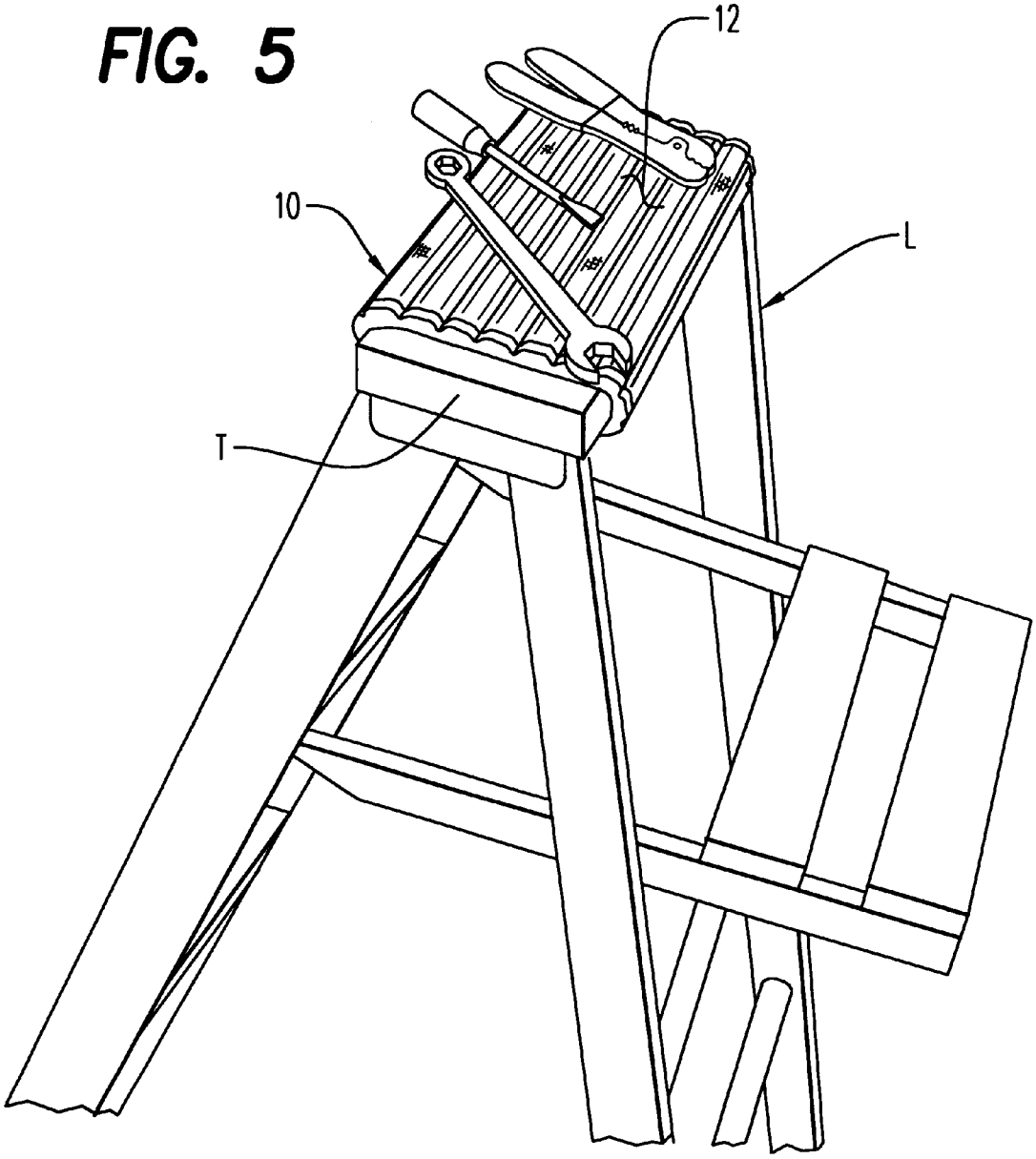
FIG. 5 is a perspective view of the invention in use atop a collapsible step ladder.
Figure 6:
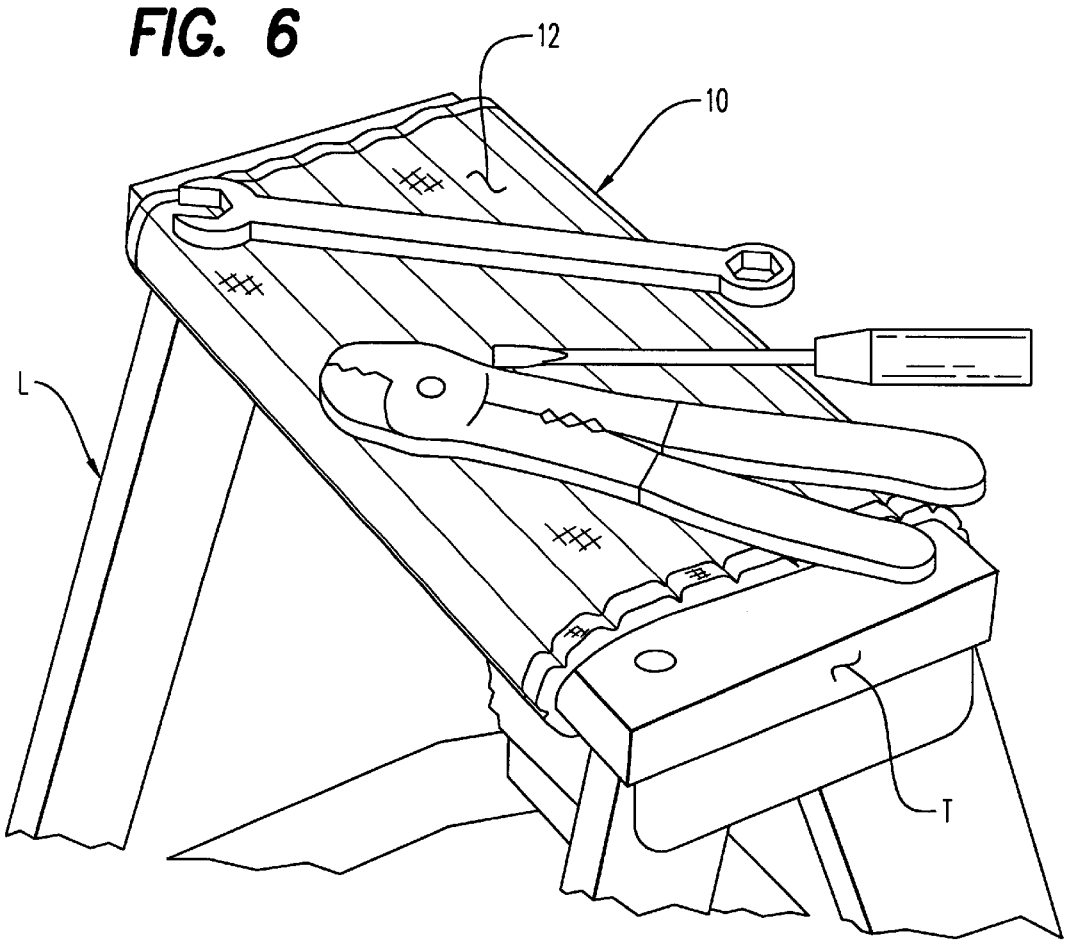
FIG. 6 is an enlarged view of the upper portion of the step ladder of FIG. 5.

Referring additionally to FIGS. 5 and 6, the preferred embodiment of the invention 10 is sized in length and width to substantially cover the top step T of a conventional step ladder L. This top step T is typically utilized to support tools and other accessories and work implements such as there shown in FIGS. 5 and 6 and additionally nails, screws, brads, marking implements and the like. Virtually all of these items are typically formed of magnetically attractable material. By dimensionally structuring the device 10 so as to substantially cover this top step T with the closely spaced magnetic bars 16 positioned immediately beneath the obverse panel 12, the utility and versatility of the collapsible ladder L is greatly enhanced.

To secure the tool mat 10 atop the top step T, one or a plurality of elongated attaching straps 22 are connected to and extend lengthwise from one end margin of the tool mat T. Each of these attaching straps 22 has one surface thereof at 24 which contains one part of a conventional two-part hook and loop releasable attaching arrangement. The mating portion 26 of this hook and loop arrangement is attached to adjacent the opposite end portion of the device 10. When positioned around the top step T, the attaching surface 24 of each of the attaching straps 22 will releasably engage against the attaching surfaces 26 to secure the device 10 in the position shown in FIGS. 5 and 6.

Referring particularly to FIGS. 4, by the material selection of the obverse and reverse panels 12 and 14, the spacing of the holding portions or pouches formed between the seam lines 18*a* and 18*b* and more generally at 18, and by arranging the generally rectangular cross section magnet bars 16 with alternately facing polarities S and N, pairs of magnet bars 16 immediately adjacent one another attract one another when the device 10 is in the unfolded, flat configuration so as to automatically adopt a magnetic bar 16 pair arrangement as shown. Between closely attracted magnetic bar pairs, the thinner obverse panel 12 is drawn therebetween toward the heavier reverse panel 14 so that the seam line 18*b* is associated with a substantially flat, unbent portion of the reverse panel 14. In opposite but similar fashion, the reverse panel 14 is drawn between the magnet bar pairs so that the seam line 18*a* therebetween is drawn toward the outstretched obverse panel 12. By this arrangement, both enhanced magnetic attraction to magnetically attractable articles positioned against or in close proximity to the obverse panel 12 is achieved while enhanced stability of the entire device 10 from inadvertently folding is also achieved. Moreover, the magnet bar 16 pairs are more strongly resistant to breakage of the delicate sintered ferrite magnetic bars 16.

Figure 7:
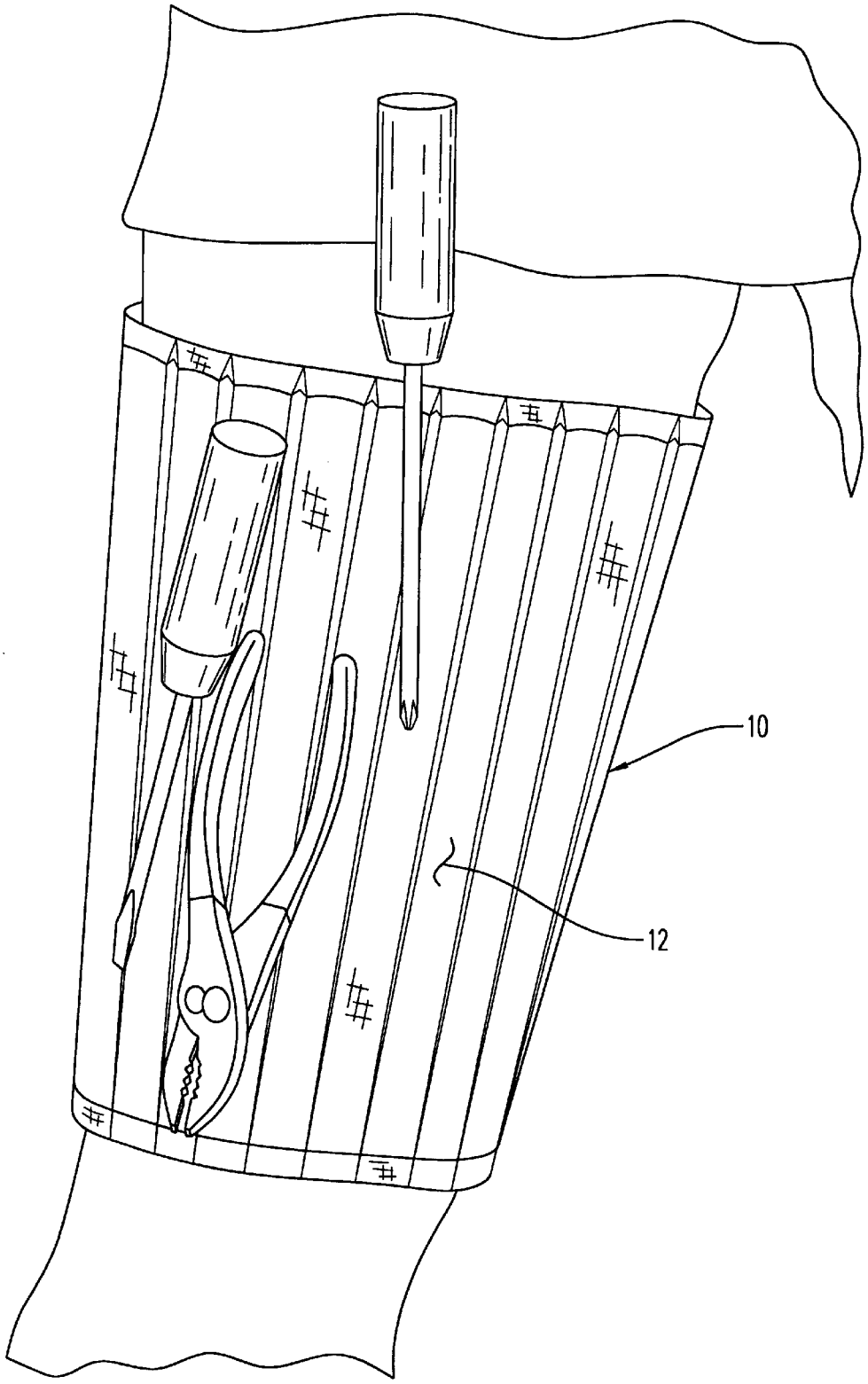
FIG. 7 is a perspective view of the invention in use attached to a thigh or upper leg of a user.

Referring now to FIGS. 3 and 7, the device 10, through the utilization of an auxiliary strap 30, shown stored in phantom in FIG. 3, may be effectively elongated and attached around the thigh or upper leg of a user. The perimeter of the thigh is typically substantially greater than the transverse circumference around the top step T of the ladder L shown in FIGS. 5 and 6 and this extra length is provided by the auxiliary strap.

To deploy the device 10 around the user's thigh, the auxiliary strap 30 is attached to one of the attaching straps 22 by mating two-part attaching material 34 and the other end portion 32 of the opposite surface of the auxiliary strap 30 is attached to the corresponding two part attaching surface 26 to secure the device 10 in the position shown in FIG. 7 for use.

Figure 8:
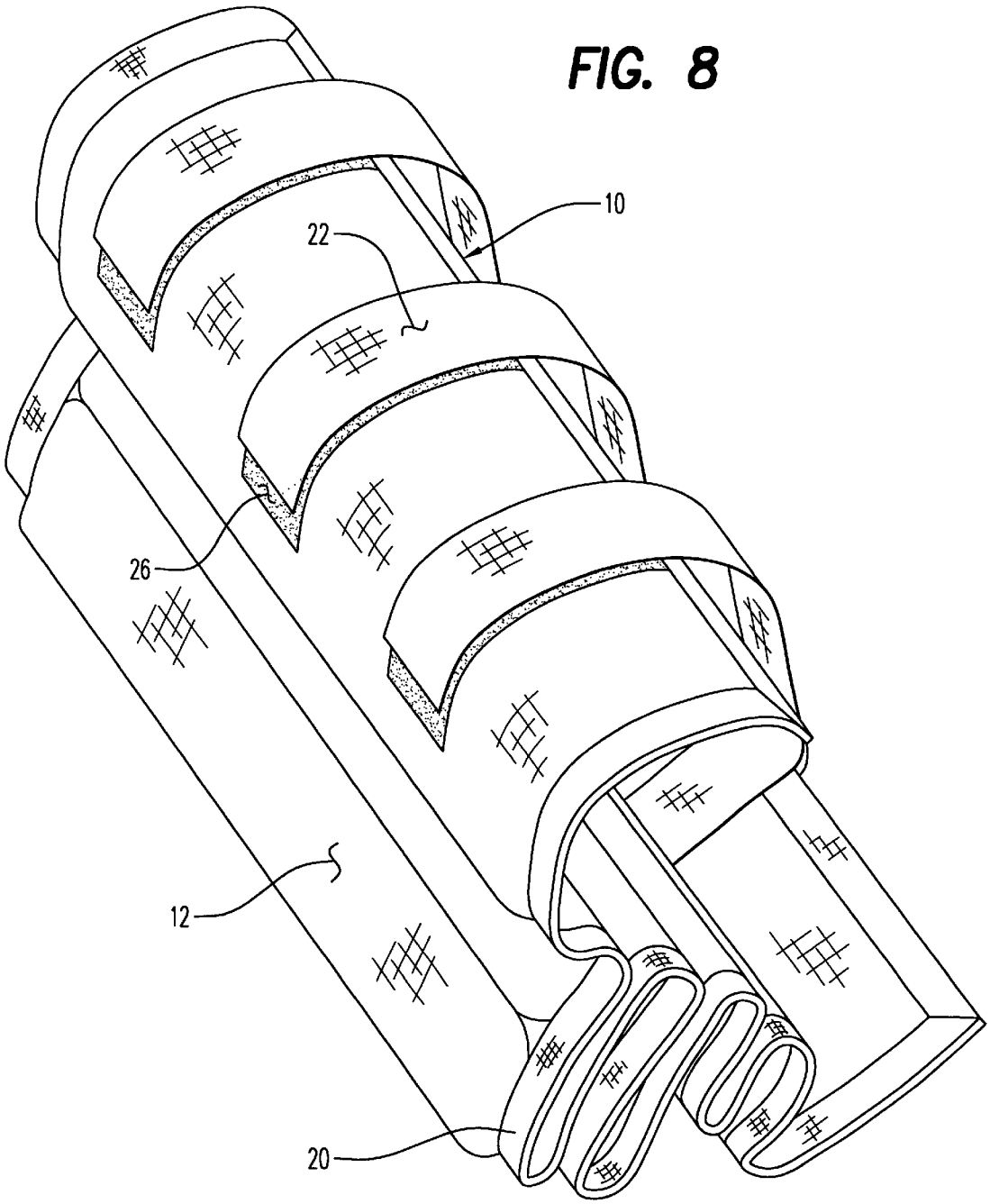
FIG. 8 is a perspective view of the invention in the collapsed configuration for storage.

Referring lastly to FIG. 8, the device 10 is easily storable into a configuration there shown by simply starting the folding movement of two or more of the magnetic bars 16 together whereupon the entire device 10 will self-collapse into the position shown in FIG. 8 wherein the obverse surface 12 is exposed so that the attaching straps 22 will be positioned in alignment with the corresponding mating two part attaching portions 26 as shown.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A foldable, portable magnetic tool mat comprising:

generally rectangular obverse and reverse panels each formed of flexible material and connected together along substantially common side and end margins thereof;

said obverse and reverse panels also connected together along evenly spaced apart seam lines extending between said side margins, each two adjacent lines defining an elongated magnet bar holding portion;

an elongated permanent magnet bar held within each holding portion, each said magnet bar sized in cross section to substantially fill one holding portion without substantially inhibiting selective folding of said tool mat along each said seam line;

said flexible material forming said reverse panel being substantially thicker than that forming said obverse panel, whereby said reverse panel being placed against a work or support surface will exhibit better wear characteristics and said obverse surface will maximize available magnetic attractive forces through said obverse panel for tool and hardware retention thereagainst;

an attaching strap connected at one end thereof to, and orthogonally extending from, a first end portion of said tool mat, a distal end of said attaching strap releasably attachable by mating hook and loop means to a second end portion of said tool mat whereby said tool mat may be held against a support surface with said reverse surface thereagainst when said attaching strap is firmly wrapped around the support surface and said distal end is releasably attached to said second end portion.

2. A tool mat as set forth in claim 1, wherein:

the support surface is a top step of a step ladder;

said tool mat is sized in length and width to be substantially equal to and to therefore substantially cover the top step.

3. A tool mat as set forth in claim 2, further comprising:

an elongated auxiliary strap releasably attachable at each end thereof between the distal end of said attaching strap and said second end portion of said tool mat whereby said tool mat may be secured for use around a user's thigh.

4. A tool mat as set forth in claim 3, wherein:

said tool mat is collapsible for storage into a bundled configuration and held in the stored configuration by mutual attraction between said magnet bars.

5. A foldable, portable magnetic tool mat comprising:

generally rectangular obverse and reverse panels each formed of flexible material and connected together along substantially common side and end margins thereof;

said obverse and reverse panels also connected together along evenly spaced apart seam lines extending between said side margins and parallel to said end margins, each two adjacent lines defining an elongated magnet bar holding portion;

an elongated permanent magnet bar held within each holding portion with adjacent magnet bars oriented with alternating surface polarities, each said magnet bar sized in cross section to substantially fill one holding portion without substantially inhibiting selective folding of said tool mat along each said seam line;

said flexible material forming said reverse panel being substantially thicker than that forming said obverse panel, whereby said reverse panel being placed against a work or support surface will exhibit better wear characteristics and said obverse surface will maximize available magnetic attractive forces through said obverse panel for tool and hardware retention thereagainst;

an attaching strap connected at one end thereof to, and orthogonally extending from, a first end portion of said tool mat, a distal end of said attaching strap releasably attachable by mating hook and loop means to a second end portion of said tool mat whereby said tool mat may be held against a support surface with said reverse surface thereagainst when said attaching strap is firmly wrapped around the support surface and said distal end is releasably attached to said second end portion.

6. A tool mat as set forth in claim 5, wherein:

the support surface is a top step of a step ladder;

said tool mat is sized in length and width to be substantially equal to and to therefore substantially cover the top step.

7. A tool mat as set forth in claim 6, further comprising:

an elongated auxiliary strap releasably attachable at each end thereof between the distal end of said attaching strap and said second end portion of said tool mat whereby said tool mat may be secured for use around a user's thigh.

8. A tool mat as set forth in claim 7, wherein:

said tool mat is collapsible for storage into a bundled configuration and held in the stored configuration by mutual attraction between said magnet bars.

* * * * *